US012180554B2

(12) United States Patent
Boehm et al.

(10) Patent No.: US 12,180,554 B2
(45) Date of Patent: Dec. 31, 2024

(54) METHOD FOR CARBURIZATION OF HDRI PRODUCED IN H2 BASED DIRECT REDUCTION PROCESS

(71) Applicant: Primetals Technologies Austria GmbH, Linz (AT)

(72) Inventors: Christian Boehm, Thalheim (AT); Robert Millner, Loosdorf (AT)

(73) Assignee: PRIMETALS TECHNOLOGIES AUSTRIA GMBH, Linz (AT)

( * ) Notice: Subject to any disclaimer, the term of this patent is extended or adjusted under 35 U.S.C. 154(b) by 676 days.

(21) Appl. No.: 16/972,916

(22) PCT Filed: Jun. 12, 2019

(86) PCT No.: PCT/EP2019/065283
§ 371 (c)(1),
(2) Date: Dec. 7, 2020

(87) PCT Pub. No.: WO2019/238720
PCT Pub. Date: Dec. 19, 2019

(65) Prior Publication Data

US 2021/0246521 A1 Aug. 12, 2021

(30) Foreign Application Priority Data

Jun. 12, 2018 (EP) ..... 18177161

(51) Int. Cl.
*C21B 13/00* (2006.01)
*B22D 7/00* (2006.01)
*C21B 13/02* (2006.01)

(52) U.S. Cl.
CPC ..... *C21B 13/0093* (2013.01); *B22D 7/005* (2013.01); *C21B 13/0073* (2013.01); *C21B 13/02* (2013.01); *C21B 2100/26* (2017.05)

(58) Field of Classification Search
CPC . C21B 13/0093; C21B 13/0073; C21B 13/02; C21B 2100/26; C21B 13/0086; C21B 13/029; C21B 13/004; B22D 7/005
(Continued)

(56) References Cited

U.S. PATENT DOCUMENTS 4,150,972 A * 4/1979 Price-Falcon ..... C21B 13/02 75/495
6,149,708 A 11/2000 Kepplinger et al.
2017/0058373 A1* 3/2017 Motamedhashemi ..... C21B 13/0073

FOREIGN PATENT DOCUMENTS

CN 1995402 A 7/2007
CN 107858471 A * 3/2018 ..... C21B 13/0073
(Continued)

OTHER PUBLICATIONS

Ripke and Kopfle, "MIDREX H2: Ultimate Low CO2Ironmaking and its place in the new Hydrogen Economy", MIDREX Sep. 2017 (Year: 2017).*

(Continued)

*Primary Examiner* — Brian D Walck
*Assistant Examiner* — Danielle Carda
(74) *Attorney, Agent, or Firm* — Liang & Hennessey LLP; Brian Hennessey

(57) ABSTRACT

The invention relates to a process for producing carburized directly reduced iron sponge from iron oxide material. Firstly, direct reduction is carried out by means of a reduction gas consisting at least predominantly of $H_2$ and the carbon content in the iron sponge is then increased by means of a carburizing gas which is fed in, after which used carburizing gas is at least partly taken off while largely avoiding mixing with the reduction gas. The plant for producing carburized directly reduced iron sponge from iron oxide material comprises a reduction zone for directly (Continued)

reducing introduced iron oxide material to directly reduced product by means of reduction gas consisting predominantly of $H_2$ and a reduction gas feed conduit opening into the reduction zone. It also comprises a carburization zone having a carburizing gas feed conduit opening into the carburization zone and a carburization offgas conduit.

9 Claims, 7 Drawing Sheets

(58) Field of Classification Search
USPC ..... 75/490
See application file for complete search history.

(56) References Cited

FOREIGN PATENT DOCUMENTS

| | | | | | |
|---|---|---|---|---|---|
| JP | 2017057445 | A * | 3/2017 | ..... | C21B 13/00 |
| RU | 2176672 | C2 | 12/2001 | | |
| RU | 2190022 | C2 | 9/2002 | | |
| WO | 9924625 | A1 | 5/1999 | | |
| WO | 2007088166 | A1 | 8/2007 | | |
| WO | WO-2011012964 | A2 * | 2/2011 | ..... | B01D 53/1475 |
| WO | 2013064870 | A1 | 5/2013 | | |
| WO | 2014040989 | A2 | 3/2014 | | |
| WO | WO-2018078477 | A1 * | 5/2018 | | |

OTHER PUBLICATIONS

CN-107858471-A Translation (Year: 2018).*
JP-2017057445-A Translation (Year: 2017).*
International Search Report and Written Opinion received in International Application No. PCT/EP2019/065283 dated Jul. 1, 2019, pp. 14.
Russian Office Action received in Russian Application No. 2020140633/05(075627) dated Feb. 1, 2022, pp. 13.
Indian Office Action received in Indian Application No. 202017052639 dated Nov. 17, 2021, pp. 12.

* cited by examiner

METHOD FOR CARBURIZATION OF HDRI PRODUCED IN H2 BASED DIRECT REDUCTION PROCESS

CROSS-REFERENCE TO RELATED APPLICATIONS

The present application is a national phase application of PCT Application No. PCT/EP2019/065283, filed Jun. 12, 2019, entitled "PRODUCING CARBURIZED SPONGE IRON BY MEANS OF HYDROGEN-BASED DIRECT REDUCTION", which claims the benefit of European Patent Application No. 18177161.9, filed Jun. 12, 2018, each of which is incorporated by reference in its entirety.

BACKGROUND OF THE INVENTION

1. Field of the Invention

The present technology relates to a process for producing directly reduced iron sponge from iron oxide material, wherein direct reduction is carried out by means of a reduction gas consisting at least predominantly of $H_2$.

2. Description of the Related Art

Producing iron sponge by direct reduction of iron oxide material by means of hydrogen is known. Such processes are described in, for example, WO 9924625 and WO 2014040989. Consumed reduction gas exiting from the reduction apparatus after the direct reduction, referred to as topgas, can be recirculated very simply for reduction purposes since virtually only dust and water have to be separated off to any appreciable extent from the reducing component hydrogen $H_2$. The topgas may also contain some $CO_2$ due to calcination of iron oxide material used. When nitrogen is used for sealing purposes during charging of the iron oxide material into the reduction apparatus and/or during discharge of iron sponge, for example conceived as a cyclic material lock system or dynamic lock system, the topgas can also contain some nitrogen. However, the use of a reduction gas having a high hydrogen content leads to the carbon content in the iron sponge being very low compared to conventional direct reduction using mainly carbon monoxide CO or other carbon-containing gases such as methane $CH_4$. This can be disadvantageous in the further processing of the iron sponge, for example in EAF, since the consumption of electric energy and electrode consumption and also tap-to-tap time are increased for iron sponge having a low carbon content. This results in a significantly lower productivity of the electric arc furnace. Although an increase in the proportion of carbon-containing gases in the reduction gas can increase the carbon content in the iron sponge, this leads to an increase in the concentration of carbon-containing gas components, for instance CO, $CO_2$, $CH_4$, and increased $CO_2$ emissions in the topgas. This makes a considerable outlay in terms of apparatus and energy necessary for the removal of $CO_2$, and other undesirable nonaqueous constituents which may be present in the hydrogen $H_2$ when topgas is recirculated.

SUMMARY OF THE INVENTION

The present invention addresses the problem of providing a process and an apparatus which make it possible, in a simple way with little outlay, to obtain an iron sponge which has a carbon content capable for further processing in the direct reduction of iron oxide material using predominantly hydrogen-containing reduction gas.

This problem is solved by a process for producing carburized directly reduced iron sponge from iron oxide material, where direct reduction is firstly carried out by means of a reduction gas consisting at least predominantly of hydrogen $H_2$, characterized in that the carbon content in the iron sponge is then increased by means of a carburizing gas fed in, after which used carburizing gas is at least partly taken off while largely avoiding mixing with the reduction gas.

For the purposes of the present invention, iron oxide material is any iron oxide-containing material suitable as starting material for direct reduction for producing iron sponge. Depending on the process used for direct reduction, it can be lumpy material such as ore pellets, lump ore, oxide briquettes, or be finely particulate material. Lumpy material is suitable, for example, for direct reduction in fixed-bed reactors. Finely particulate material is suitable, for example, for direct reduction in fluidized-bed reactors.

In carburized iron sponge, the carbon content is from at least 0.5% by weight up to 5.0% by weight, and is preferably in the range from 1.0 to 3.5% by weight, with the two limits being included. The carbon can be present in bound form as iron carbide $Fe_3C$ and/or in free form as graphitic carbon C. Chemically bound carbon as iron carbide $Fe_3C$ is better and more effective for operation of an electric arc furnace (EAF).

The iron oxide material is firstly directly reduced by means of a reduction gas consisting at least predominantly of hydrogen $H_2$, for example in a reduction zone. The hydrogen content of the reduction gas can be up to 100% by volume. Preference is given to a hydrogen content of at least 80% by volume, particularly preferably at least 90% by volume, with the balance to 100% by volume being, for example, nitrogen $N_2$, carbon monoxide CO, carbon dioxide $CO_2$, water vapor $H_2O$, methane $CH_4$. The carbon content of the iron sponge obtained in this direct reduction is then increased, for example in a carburization zone. To bring about the increase, a carbon-containing gas, known as carburizing gas, is supplied to the sponge. The carburizing gas contains carbon in carbon-containing molecules. The carburizing gas can, for example, be natural gas, methane $CH_4$, ethane $C_2H_6$, propane $C_3H_8$, butane $C_4H_{10}$, carbon monoxide CO or a mixture of a plurality of these gases. The carbon-containing molecules react with the iron sponge to form iron carbide $Fe_3C$, or they react with liberation of carbon C.

For example, the carburization using methane proceeds as follows $$3Fe+CH_4 \rightarrow Fe_3C+2H_2$$

Or elemental carbon is formed, for example, by cracking of methane $$CH_4 \rightarrow C+2H_2$$

Owing to the subsequent reduction reaction of the resulting hydrogen $H_2$ with iron ore, water vapor ($H_2O$) is formed according to the following reaction and this also reacts with the methane ($CH_4$) which may be present by way of example via a reforming reaction:

$$FeO+H_2 \rightarrow Fe+H_2O$$

$$CH_4+H_2O \rightarrow CO+3H_2$$

Subsequently, $CO_2$ and water vapor are also formed from the CO $$FeO+CO \rightarrow Fe+CO_2$$

$$3Fe+2CO \rightarrow Fe_3C+CO_2$$

$$3Fe+CO+H_2 \rightarrow Fe_3C+H_2O$$

$$CO+H_2 \rightarrow C+H_2O$$

$$CO+H_2O \leftrightarrow CO_2+H_2$$

$$2CO \rightarrow C+CO_2$$

The product of this carburizing step having a carbon content which is increased compared to the product of the first step, namely the direct reduction, iron sponge, is for the purposes of the present patent application referred to as carburized iron sponge. In effecting the increase in the carbon content, here referred to as carburizing or carburization, carburizing gas is partially reacted. Mixing of non-hydrogen $H_2$ gaseous products, for example $CO_2$, CO, of the reactions leading to carburization or of unreacted partial amounts of the carburizing gas, for example $N_2$, with the reduction gas consisting predominantly of hydrogen $H_2$ introduced into the reduction apparatus may make an outlay for removal necessary when topgas is recirculated.

In order to keep this outlay small, or avoid it entirely, used carburizing gas is at least partly taken off while largely avoiding mixing with the reduction gas. The used carburizing gas, which is at least partly, preferably completely, taken off, contains both gaseous products of the reactions leading to carburization and also unreacted partial amounts of the carburizing gas. The taking-off is carried out in such a way that mixing of the used carburizing gas with the reduction gas is largely, preferably completely, avoided.

Substantial avoidance of mixing with the reduction gas is considered to have taken place when the total proportion of carbon-containing gases, for example CO, $CO_2$, $CH_4$ or higher hydrocarbons, in the topgas is below 20% by volume, preferably below 10% by volume, particularly preferably below 5% by volume. These values are based on measurements after cooling of the topgas and condensation of water vapor from the topgas. "Total" means that the proportions of the individual carbon-containing gases are added up; for example at 8% by volume of CO, 7% by volume of $CO_2$ and 4% by volume of $CH_4$ the total would be 19% by volume and thus below the required limit of 20% by volume.

The used carburizing gas is thus at least partly, preferably completely, taken off before mixing with the reduction gas occurs. The objective here is to have only very small or no gas flows from the carburization zone into the reduction zone. This can, for example, be achieved by such an amount of used carburizing gas being taken off from the carburization zone and such an amount of used carburizing gas being separated off from a circuit of the carburizing gas that backflow from the carburization zone into the reduction zone does not take place. The used carburizing gas is effectively discharged, for example, laterally from an upper region of the carburization zone before it reaches the reduction zone above.

Accordingly, a reduction, for example, of the amount of $CO_2$ in the topgas intended for recirculation, for example by means of a $CO_2$ scrub or $CO_2/H_2O$ reformer, is dispensed with in the process of the invention. The process is also then carried out without reduction of the amount of $CO_2$ in the topgas intended for recirculation, if the topgas also contains some $CO_2$ due to calcination of the iron oxide material used. To avoid accumulation of this $CO_2$ or other undesirable gas components which may be present in the topgas when recirculation is carried out, a first partial amount of the topgas is excluded from the recirculation and discharged from the circuit. This first partial amount may optionally be fed to a use, for example use as fuel gas.

The less mixing of the carburization offgas with the reduction gas takes place, the smaller the amount of topgas which has to be excluded from the recirculation, and the more energy-efficiently can the production of the carburized directly reduced iron sponge be carried out.

An outlay for separating undesirable components from a topgas to be recirculated can be avoided by carrying out the carburization as per the invention after the direct reduction and subsequently taking off used carburizing gas.

In a preferred embodiment, a first partial amount of the used carburizing gas is, after treatment such as dust removal, combined again with fresh carburizing gas components as carburizing gas for increasing the carbon content of the iron sponge.

In this way, the carburization can be carried out more economically with greater conservation of resources since unreacted components present in the used carburizing gas can again have the opportunity of contributing to the carburization.

In a preferred embodiment, the carburizing gas or the treated used carburizing gas is heated before or after being combined with fresh carburizing gas components before coming into contact with the iron sponge. Thus, heating of at least one member of the group consisting of the two members, carburizing gas and treated used carburizing gas before or after being combined with fresh carburizing gas components, occurs before it comes into contact with the iron sponge.

The carburization reactions proceed better at relatively high temperatures. Accordingly, the efficiency of the carburization is increased by increasing the temperature.

In a preferred embodiment, the reduction gas is heated before it comes into contact with the iron oxide material. A second partial amount of the used carburizing gas is, optionally after dust removal, advantageously fed to utilization as fuel gas for heating the reduction gas. Components having a calorific value which are present in the used carburizing gas are utilized within the process, which reduces the use of resources required and improves the economics of the process. The utilization within the process can, for example, also encompass a steam generator or a power station. The reduction gas is preferably heated to above 700° C. by indirect heat exchange. Single-stage heating by indirect heat exchange, i.e. heating with retention of the reduction potential of the reduction gas, or without oxidative destruction of reduction potential of the reduction gas, is preferably carried out.

However, multistage heating of the reduction gas, in which one stage is indirect heat exchange, can also be carried out. For example, heating by indirect heat exchange to a temperature above 700° C. can be carried out in a first stage and then, in a second stage, direct heating by means of another type of heating, for example by means of partial oxidation, can be carried out to set an even higher temperature.

In a preferred embodiment, a further partial amount of the used carburizing gas is, optionally after dust removal, fed to utilization as fuel gas for heating the carburizing gas. Components having a calorific value which are present in the used carburizing gas are utilized within the process; this reduces the use of resources necessary and improves the economics of the process.

In a preferred embodiment, the heating of the reduction gas and the heating of the carburizing gas are carried out in the same heating apparatus. This requires less outlay in terms of apparatus and makes the process simpler to carry out.

In a preferred embodiment, used reduction gas is taken off as topgas and a first partial amount of the topgas is fed to a use as fuel gas for heating the reduction gas and/or the carburizing gas. Components having a calorific value which are present in the topgas are utilized within the process; this reduces the use of resources necessary and improves the economics of the process.

In a preferred embodiment, the carburizing gas contains components which react exothermically with the directly reduced iron sponge. The carburization reactions proceed better at relatively high temperatures. Accordingly, increasing the temperature improves the efficiency of the carburization.

In a preferred embodiment, the iron sponge is heated before and/or during the introduction of the carburizing gas. The carburization reactions proceed better at relatively high temperatures. Accordingly, the efficiency of the carburization is increased by the temperature increase.

In a preferred embodiment, solid carbon C is mixed with the iron sponge before and/or during and/or after introduction of the carburizing gas. This supplements the increase in the carbon content by means of the carburizing gas. This also assists in the desired maintenance of the carbon content in the iron sponge at a constant value, for example a constant carbon content is desirable in the case of later use in an EAF.

For example, the following reaction occurs:

$$3Fe+C \rightarrow Fe_3C$$

The solid carbon can, for example, be anthracite.

To set a very constant carbon content in the iron sponge, elemental carbon can be added in metered form, for example by means of a metering screw or star feeder. In addition to the addition of carbon, carbon can optionally also be mixed with the iron sponge, for example in a mixing chamber or a mixer in order to achieve thorough mixing and an increased proportion of iron carbide. Here the term mixer refers to an apparatus having moving internals, while a mixing chamber does not have any moving internals.

In a preferred embodiment, the size of the second partial amount of the used carburizing gas is regulated as a function of carbon dioxide $CO_2$ and/or carbon monoxide CO and/or methane $CH_4$ content in the topgas.

The regulation is preferably carried out as a function of the content at the outlet from the reduction zone.

Mixing of the used carburizing gas with the circuit of the reduction gas should be largely, preferably completely, avoided. Monitoring of the topgas for components which indicate that mixing has occurred, carbon dioxide $CO_2$ and/or carbon monoxide CO and/or methane $CH_4$, warns of mixing. Increasing the second partial amount of the used carburizing gas contributes to suppressing any mixing which may take place.

In a preferred embodiment, the size of the first partial amount of the topgas is regulated as a function of nitrogen $N_2$ and/or carbon dioxide $CO_2$ and/or carbon monoxide CO and/or methane $CH_4$ content in the topgas.

An accumulation of these components in the recirculated topgas would have an adverse effect on the efficiency of the direct reduction. For this reason, such components should be at least partly discharged from the recirculation circuit. Monitoring of the topgas for components which indicate that mixing of used carburizing gas and reduction gas has occurred, carbon dioxide $CO_2$ and/or carbon monoxide CO and/or methane $CH_4$, warns of mixing. The adverse effects of any mixing of carburizing gas or used carburizing gas with the reduction gas which occurs can be decreased by increasing the first partial amount of the topgas.

Utilization of the discharged gas as first partial amount allows its energy to be utilized for heating. Components having a calorific value which are present in the topgas are utilized within the process; this reduces the use of resources necessary and improves the economics of the process.

The present patent application further provides a plant for producing carburized directly reduced iron sponge from iron oxide material, comprising a reduction zone for the direct reduction of introduced iron oxide material to directly reduced product by means of reduction gas consisting predominantly of hydrogen $H_2$, and comprising a reduction gas feed conduit opening into the reduction zone, characterized in that the plant also comprises a carburization zone for carburizing the directly reduced product, having a carburizing gas feed conduit opening into the carburization zone and a carburization offgas conduit going out from the carburization zone for taking off used carburizing gas from the carburization zone, and also at least one device for avoiding mixing of reduction gas with carburizing gas and/or used carburizing gas.

It is also possible for a plurality of devices for avoiding mixing of reduction gas with carburizing gas and/or used carburizing gas to be present.

A device for avoiding mixing of reduction gas with carburizing gas and/or used carburizing gas can, for example, be made up as follows: regulating device, for example a regulating valve, in the carburization offgas conduit, a compressor or a blower for discharging from the carburization zone and thus for avoiding introduction of carburizing gas into the reduction gas circuit, reduction zone and carburization zone separated by a conduit filled with iron sponge, for example with or without gas lock, with or without material flow apparatus such as a lock hopper system z, a hot rotary feeder or gravity transport.

In a preferred embodiment, the carburization offgas conduit opens into a recirculation device for treatment, for example purification, compression, heating, and recirculation of used carburizing gas into the carburizing gas feed conduit.

Such a recirculation device can, for the purposes of treatment, contain, for example, at least one dust removal device.

Such a recirculation device comprises a recirculate conduit which opens into the carburizing gas feed conduit in order to make treated used carburizing gas available as partial amount of the carburizing gas.

In this way, the carburization can be carried out more economically and with greater conservation of resources since unreacted components present in the used carburizing gas can again have the opportunity of contributing to the carburization.

In a preferred embodiment, a gas heating device is present in the carburizing gas feed conduit and/or in the recirculate conduit. The carburization reactions proceed better at relatively high temperatures. Accordingly, the efficiency of the carburization is increased by increasing the temperature.

In a preferred embodiment, a reduction gas heating device is present in the reduction gas feed conduit. This heating device is preferably a single-stage reduction gas heating device. It is preferably an indirect heat exchanger. However, it can also be a multistage heating device in which one stage is an indirect heat exchanger.

A fuel gas conduit opening into the reduction gas heating device advantageously goes out from the carburization offgas conduit and/or the recirculation device. A fuel gas feed conduit opening into the gas heating device advantageously goes out from the carburization offgas conduit and/or the recirculation device. The gas heating device is preferably a single-stage gas heating device. It is preferably an indirect heat exchanger. Components having a calorific value which are present in the used carburizing gas can then be utilized within the process; this reduces the use of resources necessary and improves the economics of the process. In a preferred embodiment, the reduction gas heating device and the gas heating device are both integrated into one heating device and the fuel gas conduit and/or the fuel gas feed conduit open into the heating device. This requires less outlay in terms of apparatus.

The plant for producing carburized directly reduced iron sponge from iron oxide material comprises a topgas conduit for taking off used reduction gas from the reduction zone. In a preferred embodiment, the topgas conduit opens into a recycling device for treatment and recycling of topgas into the reduction gas feed conduit.

Such a recycling device can, for the purposes of treatment, contain, for example, at least one dust removal device, preferably a dry dust removal device since in this case it is possible to dispense with complicated purification of process wastewater from wet dust removal in the case of a wet dust removal apparatus which is likewise possible.

Such a recycling device comprises a recirculate conduit which opens into the reduction gas feed conduit in order to provide treated topgas as partial amount of the reduction gas.

The direct reduction can in this way be carried out more economically with greater conservation of resources since unreacted components present in the topgas again have the opportunity of contributing to the direct reduction.

In a preferred embodiment, the plant for producing carburized directly reduced iron sponge from iron oxide material also comprises a fuel conduit which goes out from the topgas conduit and/or the recycling device and opens into the reduction gas heating device and/or into the gas heating device and/or the heating device. Components having a calorific value which are present in the topgas can then be utilized within the process; this reduces the use of resources necessary and improves the economics of the process.

When a dust removal device is present in the recycling device, preference is given to the fuel conduit going out downstream of the dust removal device, viewed in the flow direction of the topgas from the reduction zone. This decreases the load on plant parts gone through later, for example compressors.

In a preferred embodiment, a heating unit for heating the directly reduced product before entry into the carburization zone is present between the reduction zone and the carburization zone. In a preferred embodiment, a heating unit for heating the directly reduced product is present in the carburization zone.

In a preferred embodiment, a carbon addition device is present between the reduction zone and the carburization zone. In a preferred embodiment, a carbon addition device is present in the carburization zone.

In a preferred embodiment, a carbon addition device is present downstream, viewed in the flow direction of the directly reduced product from the reduction zone, of the carburization zone.

The carbon addition device is suitable for adding solid carbon. It can comprise metering devices such as a metering screw or star feeder. In a preferred embodiment, it also comprises mixing devices such as a mixing chamber or mixer in order to make mixing and an increased proportion of iron carbide possible.

In a preferred embodiment, the plant of the invention also comprises a regulating device for regulating the gas flow in the fuel gas conduit and/or the fuel gas feed conduit as a function of measured values obtained from the topgas. Thus, a regulating device can be one of the devices for avoiding mixing of reduction gas with carburizing gas and/or used carburizing gas.

In a preferred embodiment, the plant of the invention also comprises a regulating device for regulating the gas flow in the fuel conduit as a function of measured values obtained from the topgas.

In a preferred embodiment, the plant of the invention does not comprise any device for decreasing the amount of $CO_2$ in the topgas provided for recycling.

In a preferred embodiment, the plant of the invention comprises a discharge conduit for discharging topgas from the recycling.

In a preferred embodiment, the reduction zone and the carburization zone are accommodated within one apparatus. For example, the apparatus can be a shaft in the upper part of which the reduction zone is located and in the lower part of which the carburization zone is located. Iron oxide material is introduced from the top into the shaft and migrates downward therein under the force of gravity. During this, it is directly reduced. After passing through the reduction zone, directly reduced product goes into the carburization zone. After passing through the carburization zone, it exits from the shaft.

In a preferred embodiment, the reduction zone and the carburization zone are accommodated in different apparatuses. For example, the directly reduced product can be taken off from a direct reduction apparatus containing the reduction zone and then be introduced into a separate carburization apparatus containing the carburization zone. The directly reduced product is iron sponge. Direct reduction apparatus and carburization apparatus are connected via a supply conduit for introducing iron sponge into the carburization apparatus.

The at least one device for avoiding mixing of reduction gas with carburizing gas and/or used carburizing gas can, for example, be present in the supply conduit. It can also be present in the end of the direct reduction apparatus nearest the supply conduit. It can also be present in the end of the carburization apparatus nearest the supply conduit. It can also be present at the end of the supply conduit closest to the direct reduction apparatus, or at the end of the supply conduit closest to the carburization apparatus.

BRIEF DESCRIPTION OF THE DRAWINGS

The present invention will be illustrated by way of example below with the aid of a number of schematic figures.

DETAILED DESCRIPTION

Figure 1:
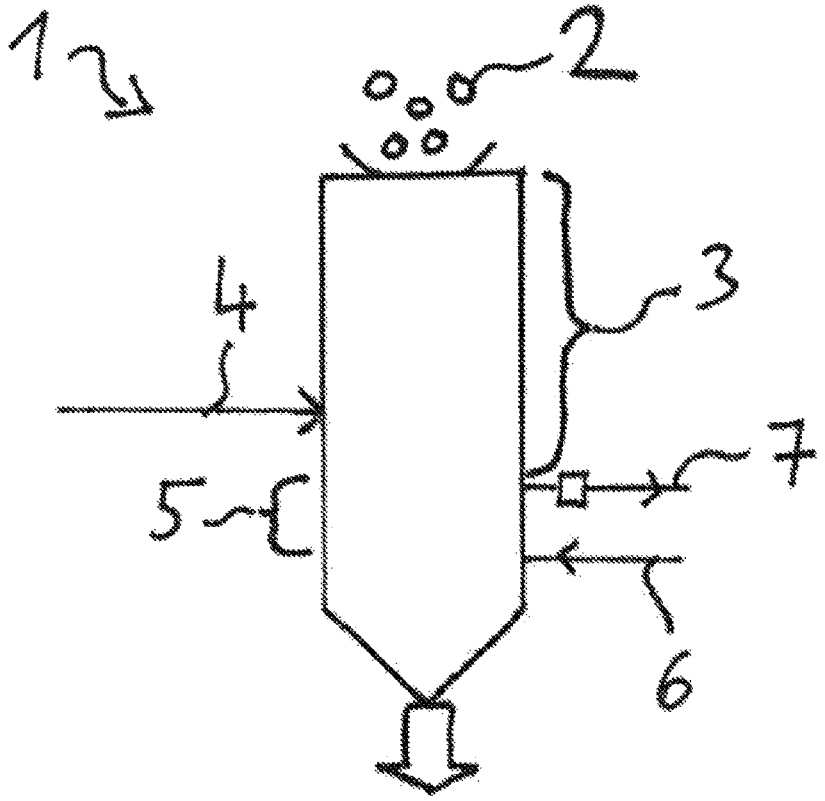
FIG. 1 schematically shows one variant of a plant according to the invention for producing carburized directly reduced iron sponge from iron oxide material.

FIG. 1 schematically shows one variant of a plant 1 according to the invention for producing carburized directly reduced iron sponge from iron oxide material 2. It comprises a reduction zone 3 for the direct reduction of introduced iron oxide material 2 to directly reduced product by means of reduction gas consisting predominantly of $H_2$. It also comprises a reduction gas feed conduit 4 opening into the reduction zone 3. It also comprises a carburization zone 5 for carburizing the directly reduced product. A carburizing gas feed conduit 6 opens into the carburization zone 5. A carburization offgas conduit 7 for taking off used carburizing gas from the carburization zone 5 goes out from the carburization zone 5. The plant also comprises at least one device for avoiding mixing of reduction gas with carburizing gas and/or used carburizing gas, here a blower 8 in the carburization offgas conduit 7. By means of the blower 8, used carburizing gas is at least partly transported out from the carburization zone and mixing with the reduction gas is in this way largely avoided. To produce carburized directly reduced iron sponge from iron oxide material 2, it is firstly directly reduced by means of the reduction gas consisting at least predominantly of $H_2$ during its passage from the top downward through the reduction zone 3 under the force of gravity. The directly reduced product iron sponge then enters, under the force of gravity, the carburization zone 5 where the carbon content in the directly reduced product iron sponge is increased by means of a carburizing gas which is fed in during its passage from the top downward under the force of gravity. Used carburizing gas is at least partly taken off and discharged by means of the blower 8 from the carburization zone 5 via the carburization offgas conduit while largely avoiding mixing with the reduction gas. Taking-off of carburized iron sponge from the carburization zone is indicated by a block arrow.

Figure 2:
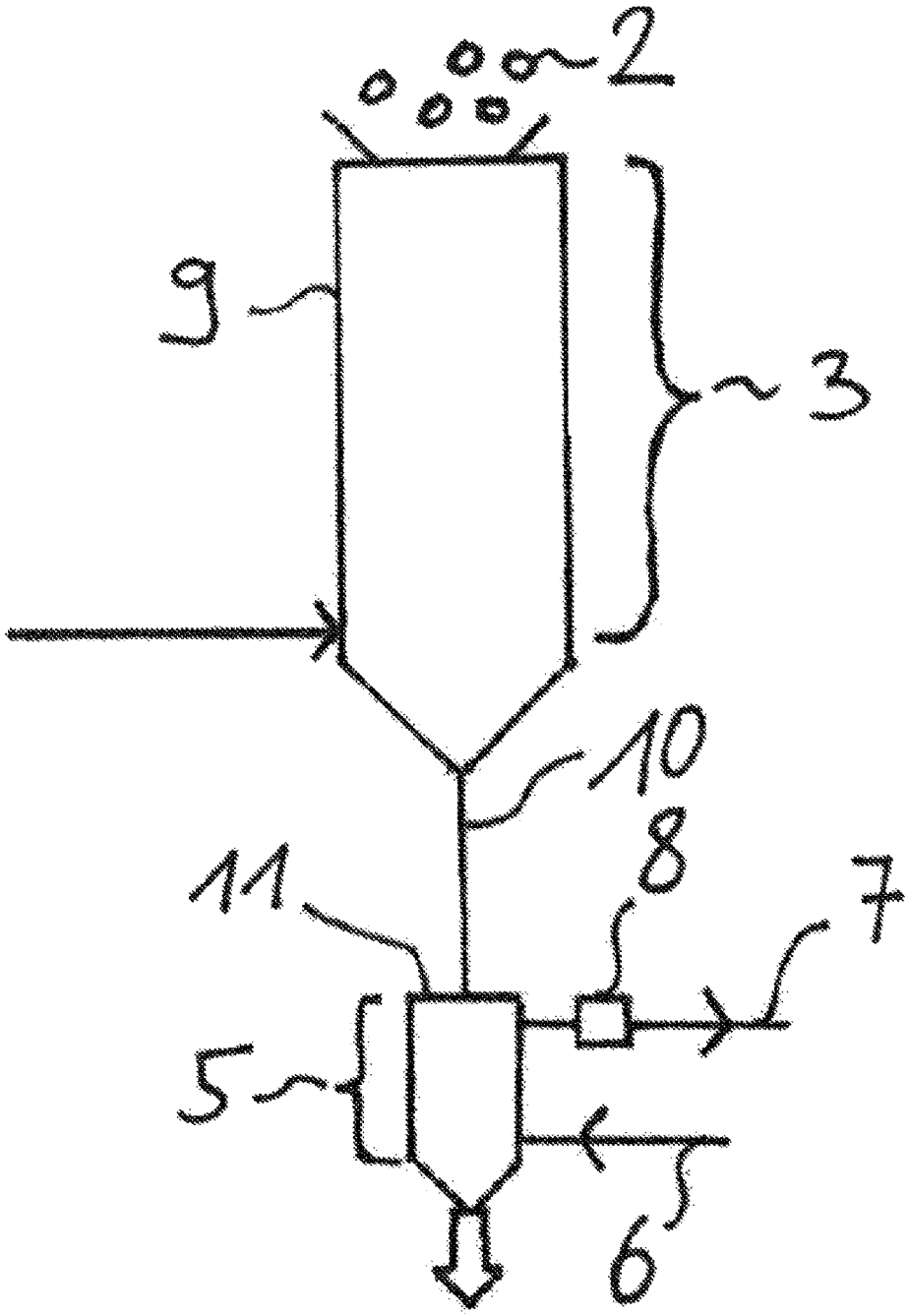
FIG. 2 schematically shows another variant of a plant according to the invention for producing carburized directly reduced iron sponge from iron oxide material.

FIG. 2 schematically shows another variant of a plant 1 according to the invention for producing carburized directly reduced iron sponge from iron oxide material 2. In contrast to FIG. 1, carburization zone 5 and reduction zone 3 are accommodated in different apparatuses. The directly reduced product iron sponge is taken off from a direct reduction apparatus containing the reduction zone, in the case depicted a fixed-bed reactor 9, and then introduced via the supply conduit 10 into a separate carburization apparatus 11 containing the carburization zone. An additional transport device, for example a star feeder, or a dynamic gas barrier can also be provided in the supply conduit 10. Plant components analogous to FIG. 1 are denoted by the same reference numerals. The device for avoiding mixing of reduction gas with carburizing gas and/or used carburizing gas, in the case depicted shown by way of example as the blower 8, could also be present in the supply conduit or in the end of the direct reduction apparatus nearest the supply conduit or in the end of the carburization apparatus nearest the supply conduit or at the end of the supply conduit closest to the direct reduction apparatus or at the end of the supply conduit closest to the carburization apparatus instead of, or in addition to, the depicted arrangement in the carburization offgas conduit. These variants are not shown in the interest of clarity. Taking-off of carburized iron sponge from the carburization zone is indicated by a block arrow.

Figure 3:
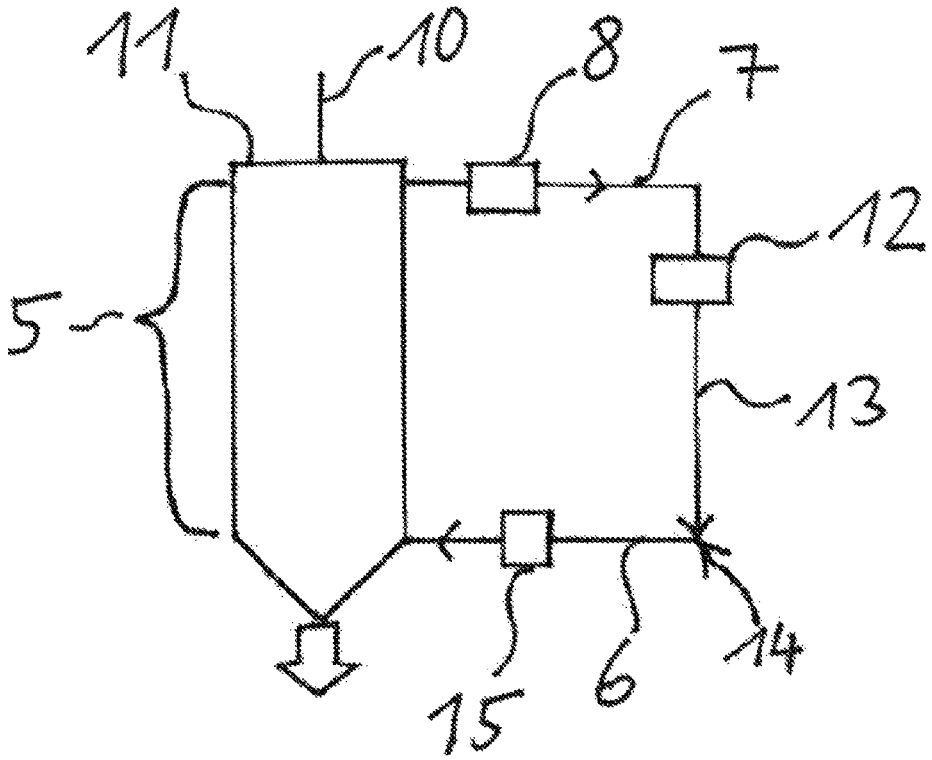
FIGS. 3 to 8 show various variants of the plant shown in FIGS. 1 and 2.

FIG. 3 shows, by way of example in a depiction largely analogous to a section of FIG. 2, how the carburization offgas conduit 7 of FIG. 2 opens into a recirculation device 12 for the treatment, for example purification, compression, heating, and recirculation of used carburizing gas into the carburizing gas feed conduit 6. A first partial amount of the used carburizing gas is, after treatment, for example dust removal, conveyed via the recirculate conduit 13 and combined with fresh carburizing gas components and reused as carburizing gas for increasing the carbon content of the iron sponge. The introduction of the fresh carburizing gas components is indicated by the arrow 14. Taking-off of carburized iron sponge from the carburization zone is indicated by a block arrow.

It is also indicated in FIG. 3 that a gas heating device 15 is present in the carburizing gas feed conduit 6. It could instead or in addition also be present in the recirculate conduit 13. The carburizing gas is heated before it comes into contact with the iron sponge.

Figure 4:
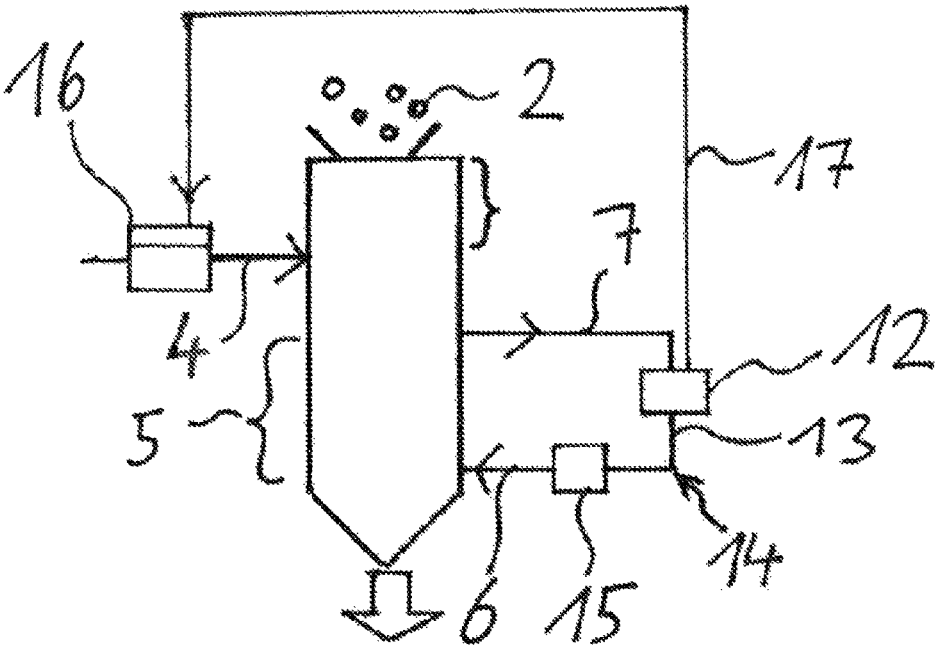

FIG. 4 shows, by way of example in a depiction which is largely analogous to FIG. 1, how a reduction gas heating device, in the case depicted an indirect heat exchanger 16 for single-stage heating of the reduction gas before it comes into contact with the iron oxide material 2, is present in the reduction gas feed conduit. A second partial amount of the used carburizing gas is, after treatment, passed to use as fuel gas for heating the reduction gas. For this purpose, a fuel gas conduit 17 which opens into the reduction gas heating device 16 goes out from the recirculation device 12.

Figure 5:
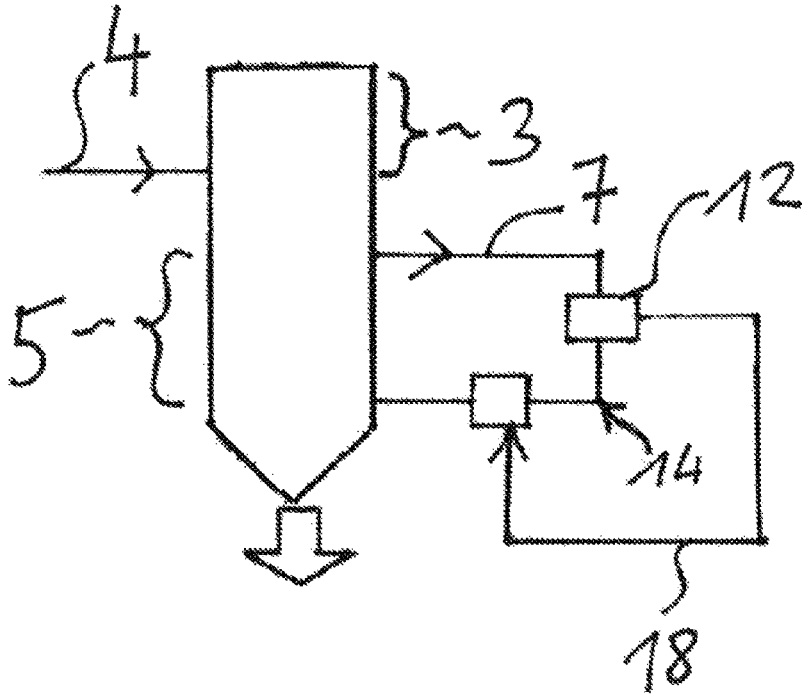

FIG. 5 shows, in a modification of the depiction in FIG. 4, how a fuel gas feed conduit 18 opening into the gas heating device 15 goes out from the recirculation device 12. A further partial amount of the used carburizing gas is passed to utilization as fuel gas for heating the carburizing gas.

Figure 6:
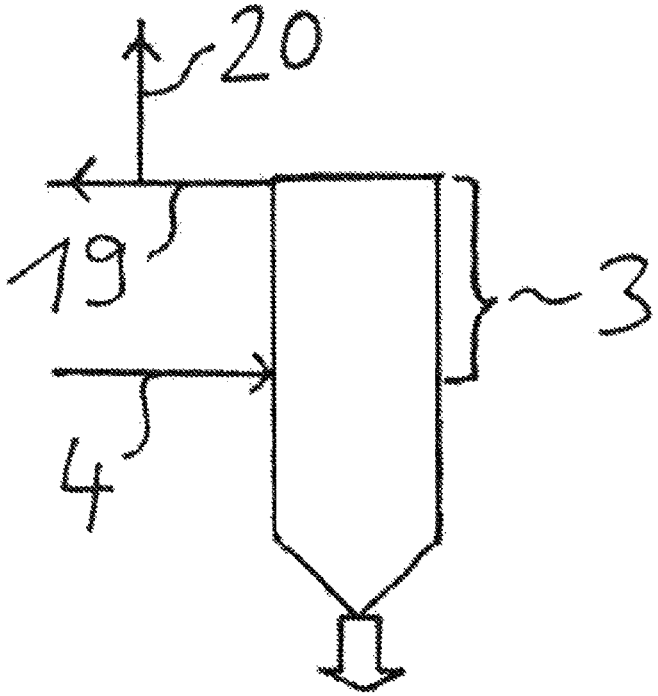

FIG. 6 shows, in a depiction largely analogous to FIG. 1, how a topgas conduit 19 goes out from the reduction zone for taking off used reduction gas. A fuel conduit 20 goes out from it and can, in the interests of clarity not shown separately, open into a gas heating device 15 or a reduction gas heating device as shown by way of example in FIGS. 3 and 4 in order to feed a first partial amount of the topgas to utilization as fuel gas for heating the reduction gas and/or the carburizing gas.

Figure 7:
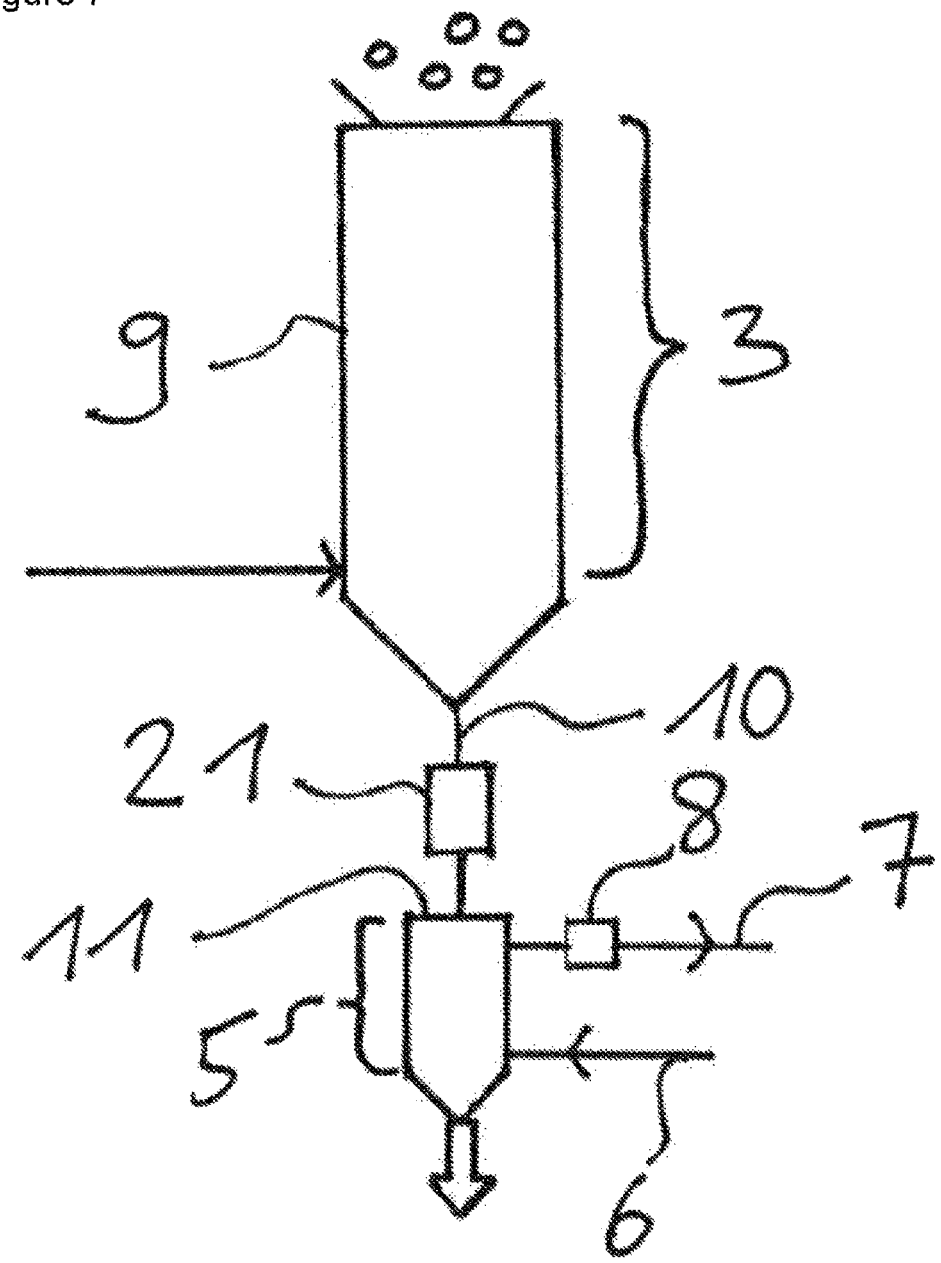

FIG. 7 schematically shows, in a modification of FIG. 2, how iron sponge can be heated by means of a heating unit 21 present in the supply conduit 10 before entry into the carburization zone.

Figure 8:
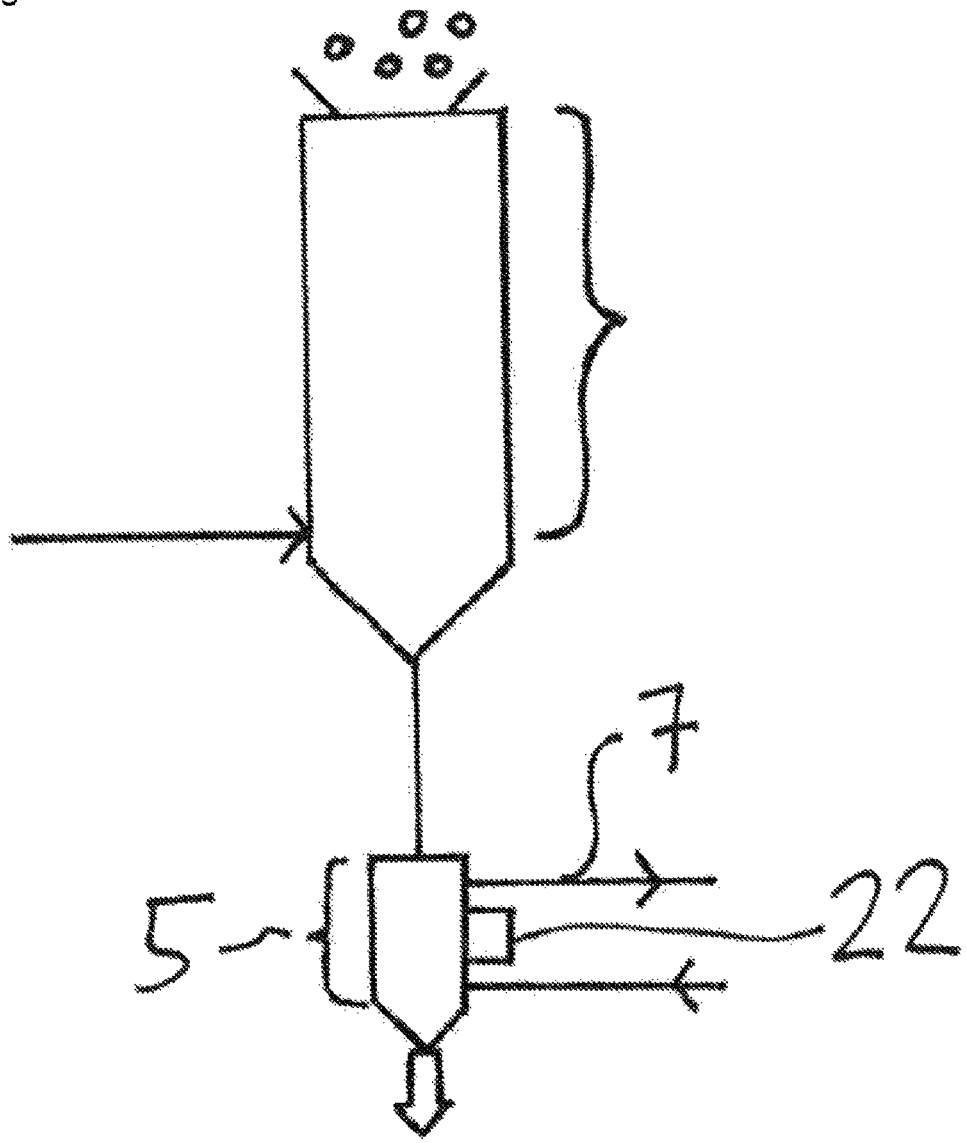

FIG. 8 schematically shows, in a modification of FIG. 2, how carbon can be introduced into the carburization zone 5 by means of a carbon addition device 22.

Figure 9:
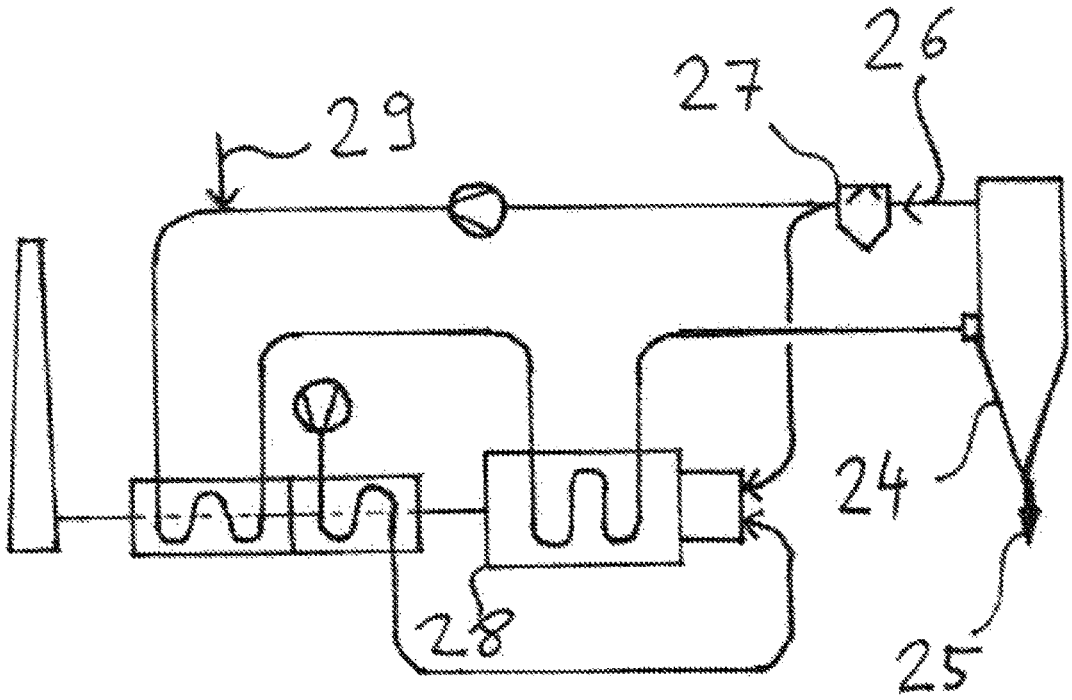
FIG. 9 schematically shows a conventional process for producing directly reduced iron sponge from iron oxide material, in which direct reduction is carried out by means of a reduction gas consisting of $H_2$.

FIG. 9 schematically shows a conventional process for producing directly reduced iron sponge from iron oxide material, in which direct reduction is carried out by means of a reduction gas consisting of $H_2$. The $H_2$ reduction gas is introduced via the reduction gas feed conduit 23 into the reduction reactor 24. Iron sponge 25 is taken off from the bottom of the reduction reactor 24. Used reduction gas after the reduction is taken off as topgas at the top of the reduction reactor 24 via the topgas conduit 26. The major part of the topgas is, after condensation of water and purification, recirculated into a scrubber 27, while a partial amount is fed as fuel to a reduction gas furnace 28. Fresh hydrogen 29 is mixed into the recirculated topgas. After preheating by means of offgas from the reduction gas furnace 28, the gas stream is heated in the reduction gas furnace 28 and then introduced into the reduction apparatus. Removal of $CO_2$ from the recirculation circuit is not necessary.

Although the invention has been illustrated and described in detail by means of the preferred working examples, the invention is not restricted by the examples disclosed and other variants can be derived therefrom by a person skilled in the art without going outside the scope of protection of the invention.

LIST OF REFERENCE NUMERALS

1 Plant for producing carburized directly reduced iron sponge from iron oxide material
2 Iron oxide material
3 Reduction zone
4 Reduction gas feed conduit
5 Carburization zone
6 Carburizing gas feed conduit
7 Carburization offgas conduit
8 Blower
9 Fixed-bed reactor
10 Supply conduit
11 Carburization apparatus
12 Recirculation device
13 Recirculate conduit
14 Addition
15 Gas heating device
16 Indirect heat exchanger
17 Fuel gas conduit
18 Fuel gas feed conduit
19 Topgas conduit
20 Fuel conduit
21 Heating unit
22 Carbon addition device
23 Reduction gas feed conduit
24 Reduction reactor
25 Iron sponge
26 Topgas conduit
27 Scrubber
28 Reduction gas furnace

The invention claimed is:

1. A process for producing carburized directly reduced iron sponge from iron oxide material, comprising:

firstly, directly reducing the iron oxide material in a reduction zone by a reduction gas having a hydrogen content of at least 80% by volume; and taking off a used reduction gas as a topgas;

wherein:

a carbon content in the directly reduced iron sponge is then increased in a carburization zone by a carburizing gas fed in; and after which used carburizing gas is at least partly taken off while avoiding mixing with the reduction gas, resulting in a proportion of carbon-containing gases in the topgas being less than 20% by volume;

wherein the reduction gas is heated before it comes into contact with the iron oxide material;

wherein a first partial amount of the topgas is fed to utilization as fuel gas for heating at least one of the reduction gas and the carburizing gas, and a size of the first partial amount of the topgas is regulated as a function of at least one of nitrogen $N_2$, carbon dioxide $CO_2$, carbon monoxide CO, and methane $CH_4$ content in the topgas; and wherein a second partial amount of the used carburizing gas is fed to utilization as fuel gas for heating the reduction gas, and a size of the second partial amount of the used carburizing gas is regulated as a function of at least one of carbon dioxide $CO_2$, carbon monoxide CO, and methane $CH_4$ content in the topgas.

2. The process of claim 1, wherein a first partial amount of the used carburizing gas is, after treatment, combined again with fresh carburizing gas components and used again as carburizing gas for increasing the carbon content of the iron sponge.

3. The process of claim 1, wherein heating of at least one member of the group consisting of the two members:

carburizing gas, and treated used carburizing gas before or after being combined with fresh carburizing gas components, is carried out before it comes into contact with the iron sponge.

4. The process of claim 1, wherein the carburizing gas contains components which react exothermically with the directly reduced iron sponge.

5. The process of claim 1, wherein the iron sponge is heated at least one of before and during introduction of the carburizing gas.

6. The process of claim 1, wherein solid carbon C is mixed with the iron sponge at least one of before, during, and after introduction of the carburizing gas.

7. The process of claim 1, wherein a supply conduit connects the reduction zone to the carburization zone.

8. A method for producing carburized directly reduced iron from iron oxide material, comprising:

directly reducing the iron oxide material in a reduction zone by a reduction gas having a hydrogen content of at least 80% by volume;

taking off a used reduction gas as a topgas;

increasing, after the reducing operation, a carbon content in the directly reduced iron in a carburization zone by feeding in a carburizing gas; and taking off, after the increasing of the carbon content operation, at least some of the carburizing gas, while avoiding substantial mixing of the carburizing gas with the reduction gas, resulting in a proportion of carbon-containing gases in the topgas being less than 20% by volume;

wherein the reduction gas is heated before it comes into contact with the iron oxide material;

wherein a first partial amount of the topgas is fed to utilization as fuel gas for heating at least one of the reduction gas and the carburizing gas, and a size of the first partial amount of the topgas is regulated as a function of at least one of nitrogen $N_2$, carbon dioxide $CO_2$, carbon monoxide CO, and methane $CH_4$ content in the topgas; and wherein a second partial amount of the used carburizing gas is fed to utilization as fuel gas for heating the reduction gas, and a size of the second partial amount of the used carburizing gas is regulated as a function of at least one of carbon dioxide $CO_2$, carbon monoxide CO, and methane $CH_4$ content in the topgas.

9. The method of claim 8, wherein a supply conduit connects the reduction zone to the carburization zone.

* * * * *